US005440787A

United States Patent [19]

Figueroa et al.

[11] Patent Number: 5,440,787

[45] Date of Patent: Aug. 15, 1995

[54] CLASP FOR CLOTH NECKWEAR AND THE LIKE

[76] Inventors: Raul Figueroa, 815 N. 52nd St., 1300, Phoenix, Ariz. 85008; Guillermo L. Romero, 2929 N. 70th St. #3085, Scottsdale, Ariz. 85251

[21] Appl. No.: 154,819

[22] Filed: Nov. 19, 1993

[51] Int. Cl.[6] ..... A41D 25/04

[52] U.S. Cl. ..... 24/50; 2/155; 2/157; 24/265 A; 24/306; 24/587; 24/698.1

[58] Field of Search ..... 24/49 R, 50, 52, 442, 24/306, 587, 265 A, 265 H, 698.1, 698.2, 573.1, 625; 2/155–157

[56] References Cited

U.S. PATENT DOCUMENTS

| | | | |
|---|---|---|---|
| 1,692,511 | 11/1928 | Mix | 24/265 A |
| 3,872,513 | 3/1975 | Beaudin, Jr. et al. | 2/155 |
| 4,606,079 | 8/1986 | De Woskin | 24/306 X |
| 4,875,239 | 10/1989 | Patterson, Jr. | 2/155 X |
| 5,148,582 | 9/1992 | Dennis, Jr. | 24/625 |

FOREIGN PATENT DOCUMENTS

| | | | |
|---|---|---|---|
| 1153027 | 2/1958 | France | 24/587 |

*Primary Examiner*—James R. Brittain

*Attorney, Agent, or Firm*—Parsons & Associates; Don J. Flickinger; Robert A. Parsons

[57] ABSTRACT

A clasp for cloth neckwear and the like including a first clamping member designed to substantially encircle a first end of the neckwear and fixedly clamp the first end in a retained position, a second clamping member designed to substantially encircle a second end of the neckwear and fixedly clamp the second end in a retained position, and clasping means mounted on the first and second clamping members, the clasping means being manually engageable and disengageable for forming the neckwear into a continuous loop about the neck of a wearer. The neckwear is tied with a standard knot and severed in the back to provide the two ends and the clamping members are affixed to the ends after stretching the cloth slightly.

6 Claims, 2 Drawing Sheets

60
14

60
14

19

60
14

63
62
18
35
40
19
30
30
29
18

21
40
19
20
30
18

77
75

71
78
79
70
76
82
84
85
83

CLASP FOR CLOTH NECKWEAR AND THE LIKE

BACKGROUND OF THE INVENTION

1. Field of the Invention

This invention relates to cloth neckwear and the like.

More particularly, the present invention relates to apparatus for affixing cloth neckwear and the like about the neck of a wearer.

In a further and more specific aspect, the instant invention concerns an improved clasp for cloth neckwear and the like and a method of attaching the clasp to the neckwear.

2. Prior Art

In general, each time a person wishes to don cloth neckwear, such as neckties, cravats, bowties, scarves, etc. it is necessary to carefully tie them about the neck and with an appropriate decorative knot. This can be an especially tedious task since the size and shape of the knot can easily vary, the length and position of each of the loose ends can change and each time the knot is tied and untied the cloth material of the neckwear is seriously stressed. In many instances and, with especially fragile and expensive cloth material, the cloth can actually begin to fray after only a few uses.

To alleviate this problem several prior art devices and methods have been devised to simplify the entire procedure. One such method is to simply slip the knot open far enough so that the neckwear can be slipped over the head and removed. This method is unsatisfactory because it is generally difficult to loosen the knot sufficiently to slip it along the neckwear until the neckwear can be removed. Also the neckwear experiences as much wear, or more, as if the knot were completely retied each time it is worn. Further, it can be messy and difficult to slip the neckwear over the head, especially if the wearer has a large or complicated coiffure.

In a second prior art structure the neckwear is provided with a simple loop and hook clasp at one side of the knot. While this forms a connection that is easy to see for purposes of use, it is undesirable because it is in the front adjacent the knot and can many times be seen quite easily after the neckwear is in place. Also, in many instances this type of connection gives an undesirable appearance to the neckwear, even if it is invisible. Further, these types of connections are quite difficult to attach and, if not properly attached, can produce a torque on the neckwear, since the loop and hook are generally very small, that makes it uncomfortable and gives it a poor appearance.

In a third type of prior art structure a pair of alligator clamps are affixed to the underside of the knot and these clamps, each of which are a pair of opposing, elongated metal jaws which are spring biased into a closed position, are simply opened to grip the collar on each side of the knot. In this neckwear, the knot is the entire structure as there generally is no material provided to encircle the neck. Again, this type of structure gives the neckwear a very poor appearance.

It would be highly advantageous, therefore, to remedy the foregoing and other deficiencies inherent in the prior art.

Accordingly, it is an object of the present invention to provide new and improved cloth neckwear and the like.

Another object of the present invention is to provide a new and improved clasp for cloth neckwear and the like.

And another object of the present invention is to provide an improved clasp for cloth neckwear and the like which can be easily adapted for use with virtually any cloth neckwear.

Still another object of the instant invention is to provide an improved clasp which is relatively easy to apply to cloth neckwear and the like.

Yet another object of the present invention is to provide an improved method of attaching a clasp to cloth neckwear and the like.

A further object of the present invention is to provide a method of attaching a clasp to cloth neckwear and the like which does not require any special tools or equipment.

SUMMARY OF THE INVENTION

Briefly, to achieve the desired objects of the instant invention, in accordance with a preferred embodiment thereof, a clasp for cloth neckwear and the like is provided including a first clamping member designed to substantially encircle a first end of a cloth neckwear and fixedly clamp the first end in a retained position, a second clamping member designed to substantially encircle a second end of the cloth neckwear and fixedly clamp the second end in a retained position, and clasping means mounted on the first and second clamping members, the clasping means being manually engageable and disengageable for forming the cloth neckwear into a continuous loop about the neck of a wearer.

In accordance with a further embodiment of the invention, a method of affixing a clasp to cloth neckwear is disclosed including the steps of providing a cloth neckwear having a standard decorative knot formed therein and a neck-encircling loop defined by the cloth neckwear. The neck-encircling loop is severed to define first and second ends in the cloth neckwear and a first clamping member is fixedly clamped in substantially encircling engagement on the first end of the cloth neckwear in a retained position. A second clamping member is fixedly clamped in substantially encircling engagement on the second end of the cloth neckwear in a retained position. Clasping means are mounted on the first and second clamping members, which clasping means are manually engageable and disengageable for forming the cloth neckwear into a continuous loop about the neck of a wearer and for removing the cloth neckwear from the neck of a wearer, respectively.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings, in which.

DETAILED DESCRIPTION OF THE PREFERRED EMBODIMENT

Figure 1:
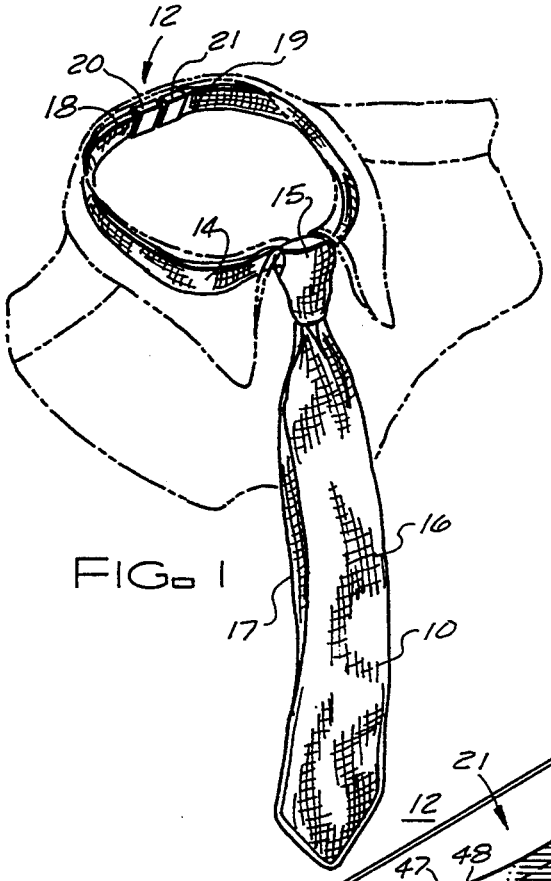
FIG. 1 is a perspective view of a necktie embodying the present invention and in position on a wearer.

Turning now to the drawings in which like reference characters indicate corresponding elements, attention is first directed to FIG. 1 which illustrates a necktie 10 having a clasp 12 assembled thereon in accordance with the present invention. While a necktie 10 is utilized in this specific example, it should be understood that virtually any cloth neckwear, including but not limited to neckties, scarves, cravats, bowties, etc., might be utilized in conjunction with the clasps described herein. Necktie 10 includes an elongated piece of cloth drawn into a loop 14 about the neck of a wearer, generally under the collar of a shirt, and tied in a decorative knot 15 at the throat of the wearer with a wider hanging end 16 and a narrower hanging end 17 positioned and held beneath wider end 16.

Figure 2:
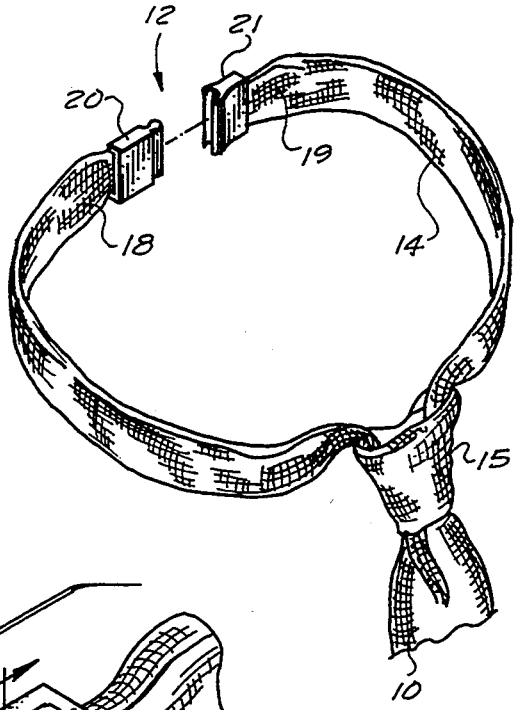
FIG. 2 is a perspective view of the necktie of FIG. 1 with the clasp disengaged.

Necktie 10 is severed at approximately the rear thereof (opposite knot 15) to provide ends 18 and 19. Two portions 20 and 21 of clasp 12 are affixed to ends 18 and 19, respectively, as will be explained presently. Portions 20 and 21 of clasp 12 are engaged to affix necktie 10 about the neck of the wearer or disengaged, as illustrated in FIG. 2, to remove necktie 10. Thus, with decorative knot 15 properly tied and hanging ends 16 and 17 at the correct length, the wearer has simply to raise his shirt collar, place necktie 10 in encircling engagement around his neck and engage portions 20 and 21 of clasp 12. Necktie 10 always remains properly tied and wear on necktie 10 is completely eliminated. Further, the wearer can open the top button of the shirt, if desired, for additional comfort and necktie 10 will not give a messy appearance.

Figure 3:
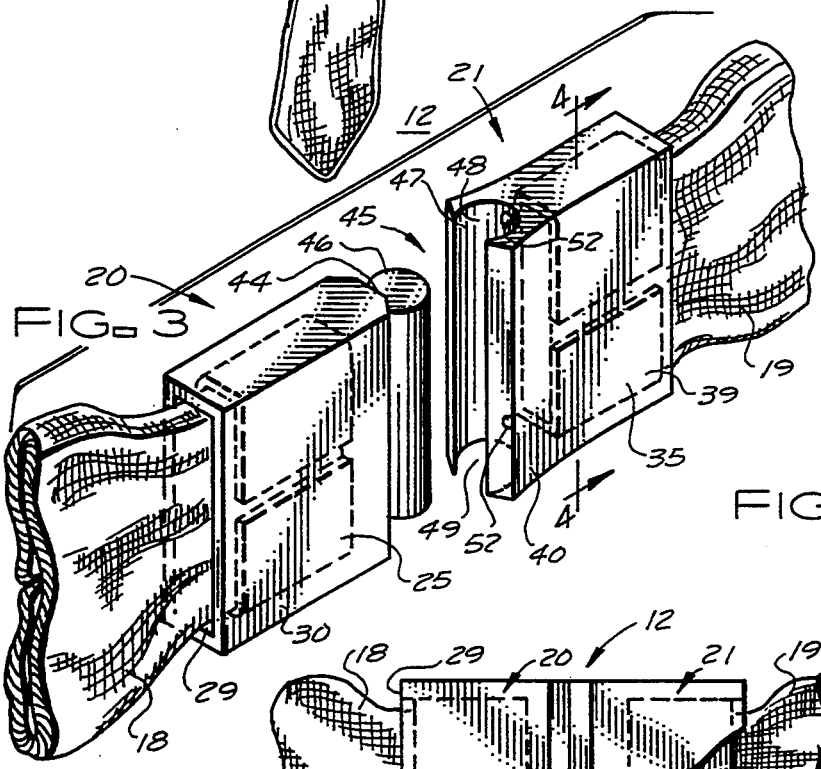
FIG. 3 is an enlarged, perspective view of the clasp in a disengaged position.
Figure 4:
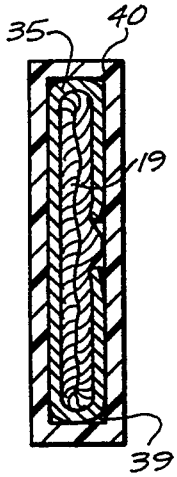
FIG. 4 is a sectional view as seen from the line 4—4 of FIG. 3.

Referring specifically to FIG. 3, an enlarged perspective view of clasp 12 is illustrated. As explained briefly above, clasp 12 includes a first portion 20 affixed to end 18 of necktie 10 and a second portion 21 affixed to end 19 of necktie 10. First portion 20 further includes a clamping member 25 fixedly clamped about end 18 of necktie 10 and nestingly and frictionally engaged in an opening 29 in a housing 30. Clamping member 25 would not be visible in FIG. 3 but is illustrated in broken lines to show its position relative to housing 30. Similarly, second portion 21 further includes a clamping member 35 fixedly clamped about end 19 of necktie 10 and nestingly and frictionally engaged in and opening 39 in a housing 40. Clamping member 35 also would not be visible in FIG. 3 but is illustrated in broken lines to show its position relative to housing 40. Also, the relationship of end 19 and clamping member 35 in opening 39 of housing 40 is illustrated in a sectional view in FIG. 4.

Clasping means 45, including a male portion and a female portion, are affixed to housings 30 and 40, respectively. In this specific embodiment, the male portion includes an elongated cylinder 46 mounted on the end of housing 30 generally along a tangent 44 of cylinder 46 so as to extend parallel to the plane of the cloth but transverse to the length or longitudinal dimension. The female portion includes a cylinder-receiving cavity 47 also extending parallel to the plane of the cloth but transverse to the length. Cavity 47 is generally C-shaped in cross-section with the bight of the C being attached to the end of housing 40. The inner diameter of cavity 47 is slightly larger than the outer diameter of cylinder 46. An upper end 48 of cavity 47 is open to receive cylinder 46 in sliding engagement within cavity 47 and a slot 49, formed by the ends of the C-shaped cavity, receives tangent 44 therein. Because slot 49 is narrower than the diameter of cylinder 46, clasping means 45 can not be disengaged by pulling on ends 18 and 19 of necktie 10.

Figure 5:
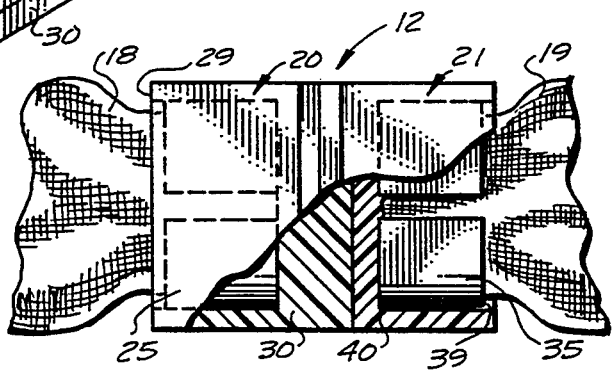
FIG. 5 is a view in front elevation of the clasp in an engaged position, portions thereof broken away and shown in section.

Once cylinder 46 is nestingly engaged in cavity 47, further transverse movement (disengaging movement) is retarded by some sort of detent, stop, or other holding structure. In the specific embodiment illustrated, a pair of projecting nubs 52 are positioned in the bight of cavity 47 and operate as detents. Preferably, housing 40 and nubs 52 are formed of a material, such as plastic, which has some flexion, thereby permitting deformation during engagement and disengagement. With cylinder 46 properly positioned in cavity 47, as illustrated in FIG. 5, nubs 52 engage the ends of cylinder 46 to hold cylinder 46 in cavity 47. Applying sufficient longitudinal pressure on one end, forces the opposing end of cylinder 46 past the engaging nub 52, allowing cylinder 46 to be disengaged from cavity 47. Other structures which might be used to retard the disengagement of cylinder 46 from cavity 47 include forming cavity 47 with one end, generally the lower end, closed to prevent cylinder 46 from passing completely therethrough, spring loaded balls, or detents in cylinder 46 or the bight of cavity 47, etc.

Figures 6, 7, 8, 9, 10, 11, 12, 13:
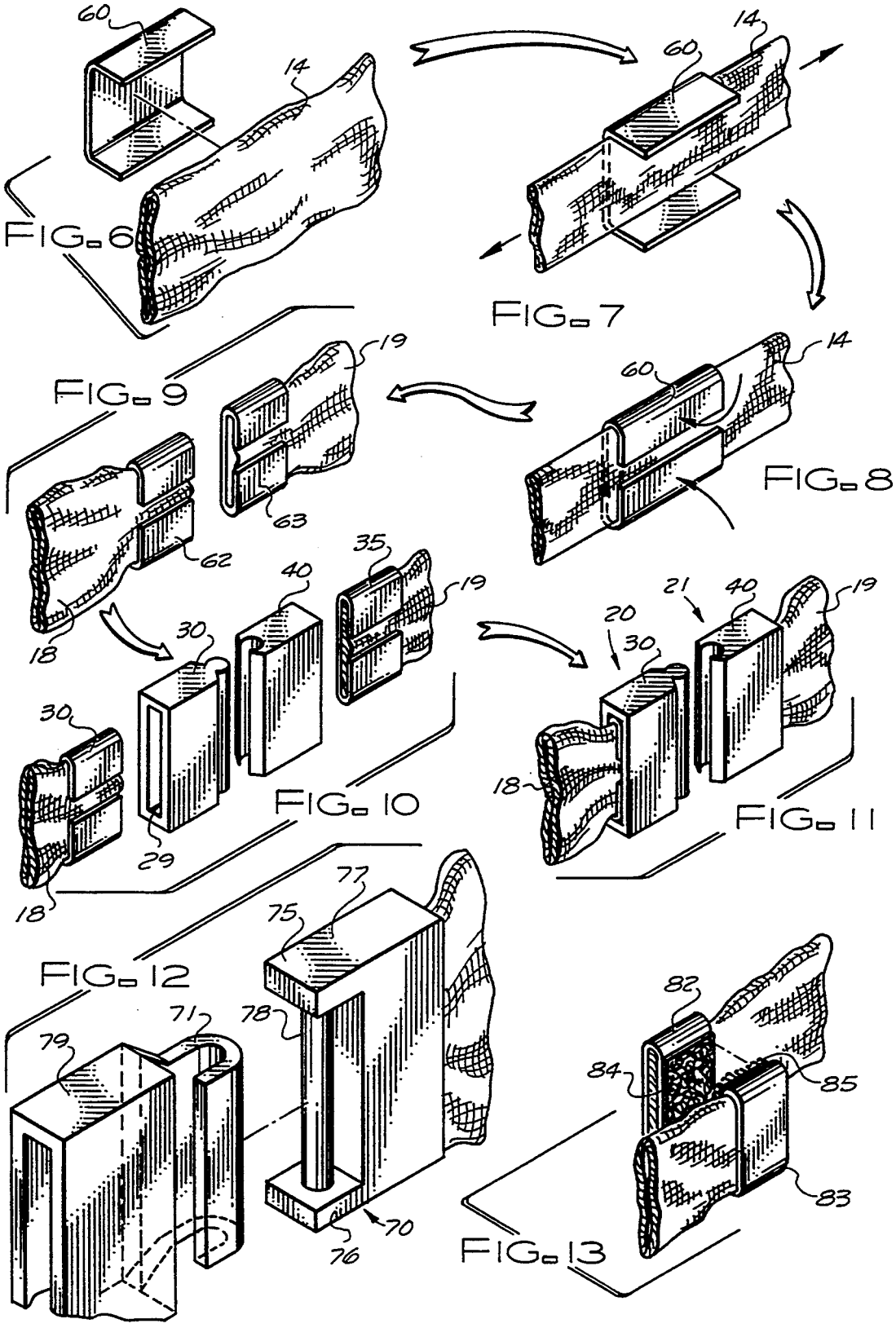
FIGS. 6–11 illustrate a series of sequential steps in the method of assembling a clasp on cloth neckwear in accordance with the present invention.
FIG. 12 is a view in perspective of a different embodiment.
FIG. 13 is a view in perspective of still another embodiment.

Referring specifically to FIGS. 6–11, several sequential steps in a method of affixing clasp 12 to necktie 10 are illustrated. FIG. 6 illustrates a portion of neck-encircling loop 14 of necktie 10 which is located generally opposite decorative knot 15, as previously explained with reference to FIG. 1. An elongated clamping member 60 is provided, which clamping member 60 has a generally U-shaped cross-section with the bight of the U being approximately the same width as the width of necktie 10. Clamping member 60 is constructed of any hard bendable or otherwise deformable material which when deformed will substantially retain the deformed position. Typical materials which might be utilized are metal (e.g., copper, tin, aluminum, etc.), deformable plastic, etc.

As can be seen from FIG. 7, the cloth material of necktie 10 is stretched lightly, or pulled in opposite longitudinal directions, to minimize the amount of cloth material within clamping member 60. With the material of neck-encircling loop 14 at a location opposite decorative knot 15 lightly stretched, clamping member 60 is positioned to partially encircle the stretched portion of neck-encircling loop 14. Clamping member 60 is then clamped about the lightly stretched portion in substantially encircling engagement with neck-encircling loop 14. As illustrated in FIG. 9, elongated clamping member 60 is then severed at approximately a mid-section by some convenient apparatus such as heavy clippers, a bandsaw, etc. The severed portions of elongated clamping member 60 are similar to clamping members 30 and 35 previously described with relation to FIG. 3 and will be designated with the same numerals. When elongated clamping member 60 is severed, neck-encircling loop 14 is also severed, so that severed portions 30 and 35 of clamping member 60 and neck-encircling loop 14 define two ends 62 and 63 of necktie 10.

Severed portions 30 and 35 of elongated clamping member 60 and the clamped ends of necktie 10, which form ends 62 and 63, are then inserted into openings 29 and 39 of housings 30 and 40, respectively. The size of openings 29 and 39 in housings 30 and 40 are such that the ends 62 and 63 are nestingly and frictionally engaged therein. The combination of the clamping action of elongated clamping member 60 and the natural tendency of the stretched cloth material to return to an unstretched position serve to hold the severed ends of neck-encircling loop 14 fixedly within severed portions 30 and 35. Further, by stretching the cloth of necktie 10 prior to clamping elongated clamping member 60 thereon, elongated clamping member 60, as well as housings 30 and 40 can be constructed with approximately the same cross-sectional size (thickness and width) as neck-encircling loop 14. Thus, as can be seen more clearly in FIG. 1, clasp 12 does not create any unsightly bulges or the like when engaged and covered by a shirt collar.

Here it should be noted that the specific type of clasping means 45 illustrated in FIGS. 1–11 is only one type of clasping means illustrated only for purposes of example. Many other types of clasping means can be devised as, for further example, a loop 70 and a loop-receiving hook 71 illustrated in FIG. 12. Loop 70 is formed by extending two portions 75 and 76 of a housing 77 outwardly in parallel spaced apart relationship and fixing an elongated rod 78 therebetween. Hook 71 is formed by extending a flat portion of a second housing 79 outwardly therefrom and bending it into a hook shape which can be engaged about rod 78 of loop 70. Because loop 70 and hook 71 are formed with transverse dimensions approximately equal to the width of the cloth, forming neck-encircling loop 14, the possibility of torsional pressures or twisting are eliminated or substantially reduced.

In still a further embodiment of clasping means 45, illustrated in FIG. 13, clamping members 82 and 83 are fixed to cloth neckwear as previously described. No housings are provided to engage clamping members 82 and 83. In this embodiment a suitable cloth material 84 as a loop element is affixed to one side of clamping member 82 by some convenient means, such as glue or the like. A piece of hook material 85 is fixedly attached to one side of clamping member 83. Cloth material 84 and hook material 85 are from a hook and loop fastener commonly found under the name VELCRO®, and positioned to engage each other and hold clamping members 82 and 83 fixedly together.

It should be noted that when housings, such as housings 30 and 40 described in conjunction with FIGS. 3 and 10, are utilized as a component of the clasping portions 20 and 21, clamping members 25 and 35 actually clamping neck-encircling loop 14 can be formed of less rigid material, such as some plastics. This occurs because housings 30 and 40 actually retain clamping members 25 and 35 in a clamped position. If the embodiment illustrated in FIG. 13 is utilized, the clamping members 82 and 83 must be more rigid to remain in the clamped position. Some additional support is provided by cloth material 84 and Velcro 85, however.

It should also be noted that, while the specific method disclosed in conjunction with FIGS. 6–11 places clamping member 60 about the neckwear and then severe clamping member 60 and the neckwear, one could severe the neckwear first and then fixedly attach first and second clamping members 25 and 35 to the ends thereof, while slightly stretching the cloth material.

Thus, new and improved cloth neckwear and the like are disclosed along with a new and improved clasp for realizing the cloth neckwear and the like. The improved clasp can be easily adapted for use with virtually any cloth neckwear and is relatively easy to apply to cloth neckwear and the like. Further, an improved method of attaching the clasp to cloth neckwear and the like which does not require any special tools or equipment is disclosed. The improved cloth neckwear is simple to don and virtually eliminates wear produced during normal tying and untying. Also, unsightly bulges are eliminated and there is no appearance of unsatisfactory clasps and the like.

The foregoing is given by way of example only. Other modifications and variations may be made by those skilled in the art without departing from the scope of the invention as defined by the following claims.

Having fully described and disclosed the present invention and preferred embodiments thereof in such clear and concise terms as to enable those skilled in the art to understand and practice same, the invention claimed is:

1. A clasp for cloth neckwear and the like comprising:

a first portion designed to substantially encircle a first end of a cloth neckwear and fixedly clamp the first end in a retained positioned;

a second portion designed to substantially encircle a second end of the cloth neckwear and fixedly clamp the second end in a retained position;

the first and second portions include elongated flat pieces of metal formed into a generally U-shape for encircling and clamping an end of the cloth neckwear;

the first portion includes a first housing defining an opening for receiving one of the generally U-shaped elongated flat pieces of metal therein in frictional nesting engagement, the second portion includes a second housing defining an opening for receiving a second one of the generally U-shaped elongated flat pieces of metal therein in frictional nesting engagement; and clasping means mounted on the first and second housings, the clasping means being manually engageable and disengageable for forming the cloth neckwear into a continuous loop about the neck of a wearer.

2. A clasp for cloth neckwear and the like comprising:

a first clamping member designed to substantially encircle a first end of a cloth neckwear and fixedly clamp the first end in a retained position;

a second clamping member designed to substantially encircle a second end of the cloth neckwear and fixedly clamp the second end in a retained position;

a first housing defining an opening for receiving the first clamping member therein in frictional nesting engagement;

a second housing defining an opening for receiving the second clamping member therein in frictional nesting engagement; and clasping means mounted on the first and second housings, the clasping means being manually engageable and disengageable for forming the cloth neckwear into a continuous loop about the neck of a wearer.

3. A clasp for cloth neckwear and the like as claimed in claim 2 wherein the clasping means includes a loop mounted on the first housing and a loop-receiving hook mounted on the second housing.

4. A clasp for cloth neckwear and the like as claimed in claim 2 wherein the clasping means includes a piece of hook material mounted on the first housing and a piece of loop material mounted on the second housing so as to be engageable by the hook material.

5. A clasp for cloth neckwear and the like as claimed in claim 2 wherein the clasping means includes an elongated cylinder mounted on the first housing generally along a tangent of the cylinder, the elongated cylinder being positioned generally in a plane of the neckwear and perpendicular to a longitudinal dimension thereof, and a cylinder-receiving cavity mounted on the second housing, the cavity having a generally C-shaped cross-section with a bright having an inner diameter larger than an outer diameter of the elongated cylinder and an opening positioned to receive the tangent of the elongated cylinder therein.

6. A clasp for cloth neckwear and the like as claimed in claim 5 wherein the clasping means further includes detents in one of the elongated cylinder and the cavity for holding the elongated cylinder and the cavity in a nestingly engaged position.

* * * * *